US005697776A

United States Patent [19]

Van Eerden et al.

[11] Patent Number: 5,697,776

[45] Date of Patent: Dec. 16, 1997

[54] VORTEX BURNER

[75] Inventors: John J. Van Eerden, Churchville; A. John Grever, Colmar; John J. Bloomer, Holland, all of Pa.

[73] Assignee: Selas Corporation of America, Dresher, Pa.

[21] Appl. No.: 671,812

[22] Filed: Jun. 25, 1996

[51] Int. Cl.[6] ..... F23D 14/12

[52] U.S. Cl. ..... 431/348; 431/284

[58] Field of Search ..... 431/348, 185, 431/284

[56] References Cited

U.S. PATENT DOCUMENTS

| | | | |
|---|---|---|---|
| 2,947,526 | 8/1960 | Buckholdt | 431/348 |
| 3,865,098 | 2/1975 | Cutler | 431/348 |
| 4,239,481 | 12/1980 | Morck, Jr. . | |
| 4,416,620 | 11/1983 | Morck, Jr. . | |

*Primary Examiner*—Carroll B. Dority
*Attorney, Agent, or Firm*—Austin R. Miller

[57] ABSTRACT

A vortex burner includes a flame ring for forming a swirling mixture of fuel gas and air and moving it in a downstream direction into a burner cup, and a deflector plate downstream of the flame ring and arranged crosswise of the flow to divert the flow outwardly along the burner cup surface.

12 Claims, 5 Drawing Sheets

VORTEX BURNER

BACKGROUND OF THE INVENTION present invention relates to a vortex burner, and more particularly to a vortex burner capable of burning efficiently either natural gas or 100% hydrogen, or liquid petroleum gas containing propane or butane or any percentage mixtures of the two, or any mixture of liquid petroleum gas with hydrogen or natural gas.

Vortex burners are nozzle mix burners utilized in various types of industrial furnaces. A vortex burner typically utilizes the angular momentum of the fuel gas, assisted by furnace draft, to entrain combustion air, mix the combustion air with the swirling gas, and inject the burning mixture onto a radiant cup portion of the burner and outwardly along the adjacent face of the furnace wall.

At one period of time natural gas will be available to the user while at another time hydrogen or liquid petroleum gas will be all that is available. Changing from one to the other presents a major problem because a furnace is usually provided with a very large number of burners each of which would need to be changed.

It is accordingly an object of the invention to provide a burner that can efficiently burn natural gas or hydrogen, or even liquid petroleum gas, and can be switched from one to the other gas without requiring any mechanical adjustments of the burner or its gas jets as long as the Wobbe index remains the same.

The conventional vortex burner typically has tangentially arranged gas jets that are not suitable for use with liquid petroleum gas or propane or butane because the heating values of this gas causes luminous flame and torching which are highly objectionable. These objectionable features result also from the reduced burner efficiency caused by the lower gas flows needed to obtain for propane the same heat release that is provided with other fuels. Smaller gas jets and higher pressures are therefore necessary to obtain flat flame performance in burning liquid petroleum gas but such small orifices are unsuited for natural gas or hydrogen because of the higher gas pressure required to obtain the rated capacity. However, having to change the fuel jets of a vortex burner so as to be able to burn a wide range of fuels is very time consuming and costly. It is accordingly an object of this invention to avoid having to change the fuel jets for that purpose.

Therefore, it would be highly desirable to provide a vortex burner which is capable of operating with either liquid petroleum gas or hydrogen, or even natural gas without having the necessity of changing gas jets and without sacrificing efficiency or economy.

The patent to Morck Pat. No. 4,239,481 granted to Selas Corporation of America on Dec. 16, 1980, discloses a vortex burner capable of burning a variety of gases having various Wobbe indices. It includes a feed pipe capable of carrying a first fuel gas and a second feed pipe disposed within the first feed pipe and capable of carrying a second fuel gas of either a higher or lower Wobbe index than that of the first fuel gas. This, of course, requires different sets of gas distribution tubes and valves, not to mention the requirement for a multiplicity of tangentially oriented jets designed to impart a whirling motion to the gaseous fuel. As in the case of vortex burners generally, the whirling gas mixes with the air and the mixture ignites and is thrown outwardly by centrifugal force onto a cup-shaped recess surrounding the burner and then outwardly to the cup and to the adjacent inside surface of the furnace wall.

The patent to Morck Pat. No. 4,416,620, granted to Selas Corporation of America Nov. 22, 1983, discloses a large capacity vortex burner designed for burning petrochemical gas. It includes a burner block having a cup-shaped recess with a special rippled surface and a passageway forming a bore in the block which is capable of carrying secondary air. An air sleeve is disposed within the bore, capable of carrying primary air. A gas supply pipe is disposed within the air sleeve. Sets of gas nozzles are provided for achieving swirling motion in the usual manner of a vortex burner, and a small deflector plate extends outwardly from the air sleeve which works in combination with a ripple-shaped surface on the adjacent burner cup for inducing outward flow by drawing a combination of fuel gas, primary air and secondary air into a specially designed ripple formed in the cup depression.

FIELD OF THE INVENTION

It has been discovered that serious problems are encountered in the alternative burning of either liquid petroleum gas or 100% hydrogen for the reasons expressed. Further, the heating and cooling associated with day-to-day furnace operation tends to cause expansion and contraction of furnace support structures, thereby creating warpage and cracking with resultant formation of potential escape passageways for recirculated flue products. Such passageways are sometimes even opened up by cracking of ceramic portions of the furnace wall or of even the burner cup itself. When large numbers of burners are mounted in a common furnace wall, all operated at different temperatures and pressures, distortion and cracking tend to cause the opening of escape passageways providing outward flow for some of the combustion products, leading to local structural overheating and possibly even destruction of supporting furnace structures. It is important to avoid the serious destructive effects of recirculation of combustion products back toward the surface of the burner cup and surrounding areas of the furnace wall.

We have also found it important when burning liquid petroleum gas to flatten the flame so that it tends to cling mainly along the surface of the burner cup. For that purpose, we have found that it is important to impose a flattening force upon the flame as it leaves the vortex burner and passes out over the surface of the burner cup.

SUMMARY OF THE INVENTION

This invention provides a vortex burner capable of burning either liquid petroleum gas or 100% hydrogen or any mixtures of the two, or of burning natural gas as another alternative. Only one set of tangentially arranged gas nozzles, and only one gas feed pipe, need be provided in the burner. Separate feed pipes or headers for liquid petroleum gas and hydrogen and natural gas are provided as needed outside of the furnace, equipped with suitable valves so the operator can at any given time select either gas or a mixture of the two, or natural gas, for actual operation.

As will be further described in detail hereinafter, a deflecting or flattening plate of novel design extends transversely of the flow stream of gas and primary air at a location spaced downstream from the gas nozzles and spaced from the surface of the burner cup. It remarkably enhances the mixing of primary air and gas, in the manner of a nozzle mix burner, and causes the flame to flatten and to flow smoothly along or cling closely adjacent to the surface of the burner cup and even of the adjoining portions of the furnace wall.

DETAILED DESCRIPTION OF THE INVENTION

Figure 1:
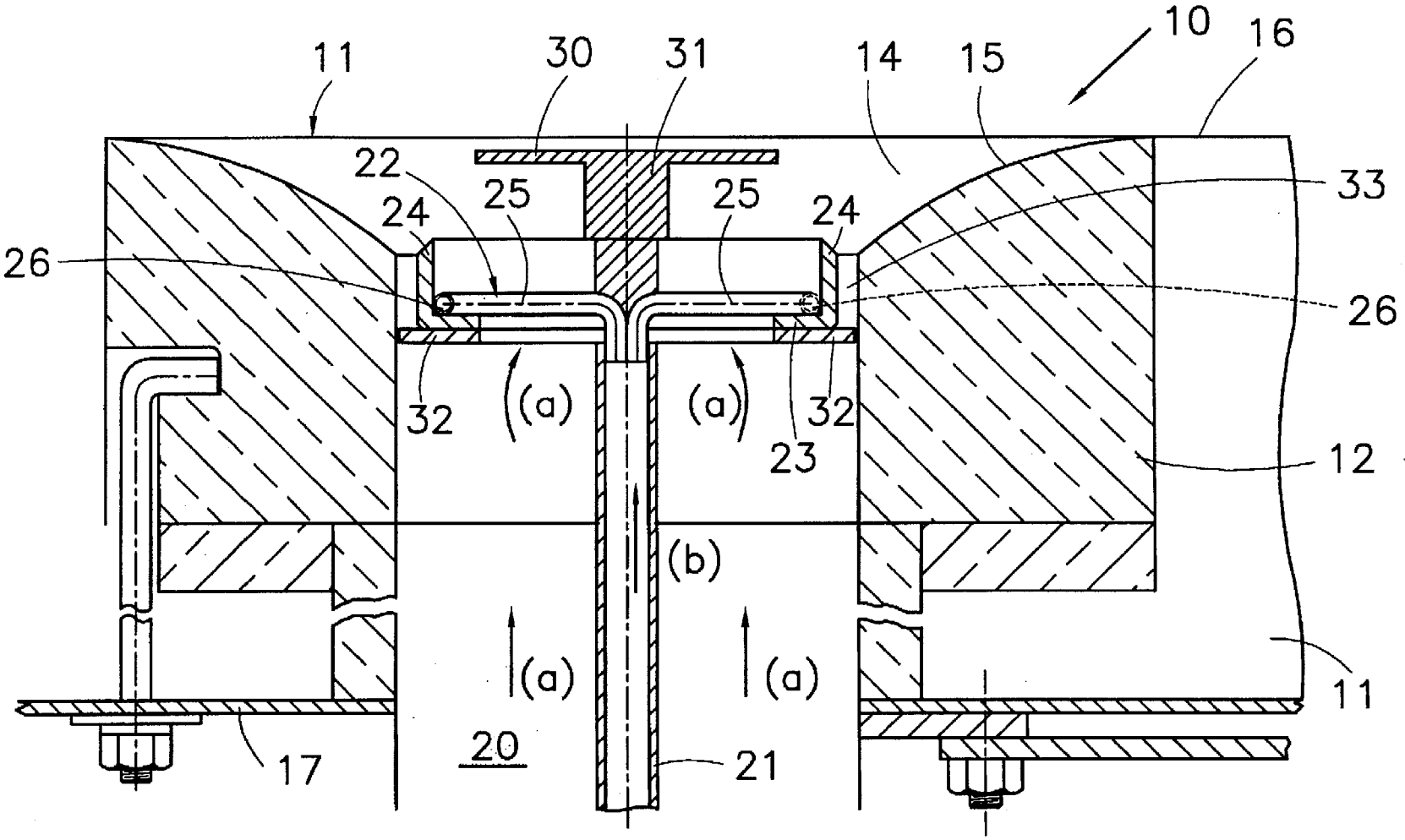
FIG. 1 is a cross-sectional view of a vortex burner embodying features of the present invention.

Referring to FIG. 1, the vortex burner 10 of the present invention is located in a portion of a furnace wall 11 of a refractory type material. The vortex burner 10 includes a burner block 12 which is disposed within the furnace wall 11, and is also typically formed of a refractory type material. The burner block 12 has a cup-shaped recess 14, preferably having a convex refractory surface 15. Block 12 extends outwardly and joins the inside surface 16 of the furnace wall 11.

The burner block 12 is secured mechanically in known manner to the furnace casing 17 and is provided with a central bore 20 for admission of primary air, which flows downstream in the direction indicated by the arrows (a) . Also mounted in the bore 20 is a fuel gas inlet tube 21 carrying incoming gas in the direction indicated by the arrow (b). The incoming gas may be natural gas, or hydrogen, or liquified petroleum gas, or propane, or butane, or a mixture.

Attached to the end of the fuel gas inlet tube 21 is a tip nozzle assembly 22 having a burner cup ring 23 and an upstanding flame ring 24 forming a cup-shaped generally cylindrical cavity for forming a vortex of the incoming fuel gas from inlet tube 21. Vortex tubes 25, 25 are positioned within the flame ring 24, each tube 25 having an inlet opening communicating within the fuel gas inlet tube 21 and having a jet opening 26, 26 arranged generally tangentially within the flame ring 24. As viewed in FIG. 1, the left-hand jet opening 26 is open toward the reader while the right-hand jet opening 26 is open away from the reader, whereby the jet openings combine with each other to generate a swirling vortex within the flame ring 24.

The number 30 designates a diverter plate which is attached to a support rod 31, which in turn is attached to the closed end of the fuel gas inlet tube 21. The diverter plate 30 is located in a plane parallel to and substantially adjacent to the plane of the inner furnace wall surface 11, or extends substantially parallel to that plane, or substantially perpendicular to the axis of the fuel gas inlet tube 21. It is preferably a rigid disk formed of high temperature alloy steel, and has a diameter equal to or somewhat less than the diameter of the central bore 20. Preferably its diameter is also somewhat less than the diameter of the flame ring 24.

The number 32 designates a modulating ring secured to the base of the burner cup ring 23 and the time ring 24 and having a central opening, as shown, through which the primary air is free to flow along the path indicated by the arrows (a) appearing in FIG. 1. The modulating ring 32 has an exterior periphery which has substantially the same diameter as the inside diameter of the central bore 20, and effectively shuts off the flow of air through the space 33 which surrounds the flame ring 24.

Figure 2:
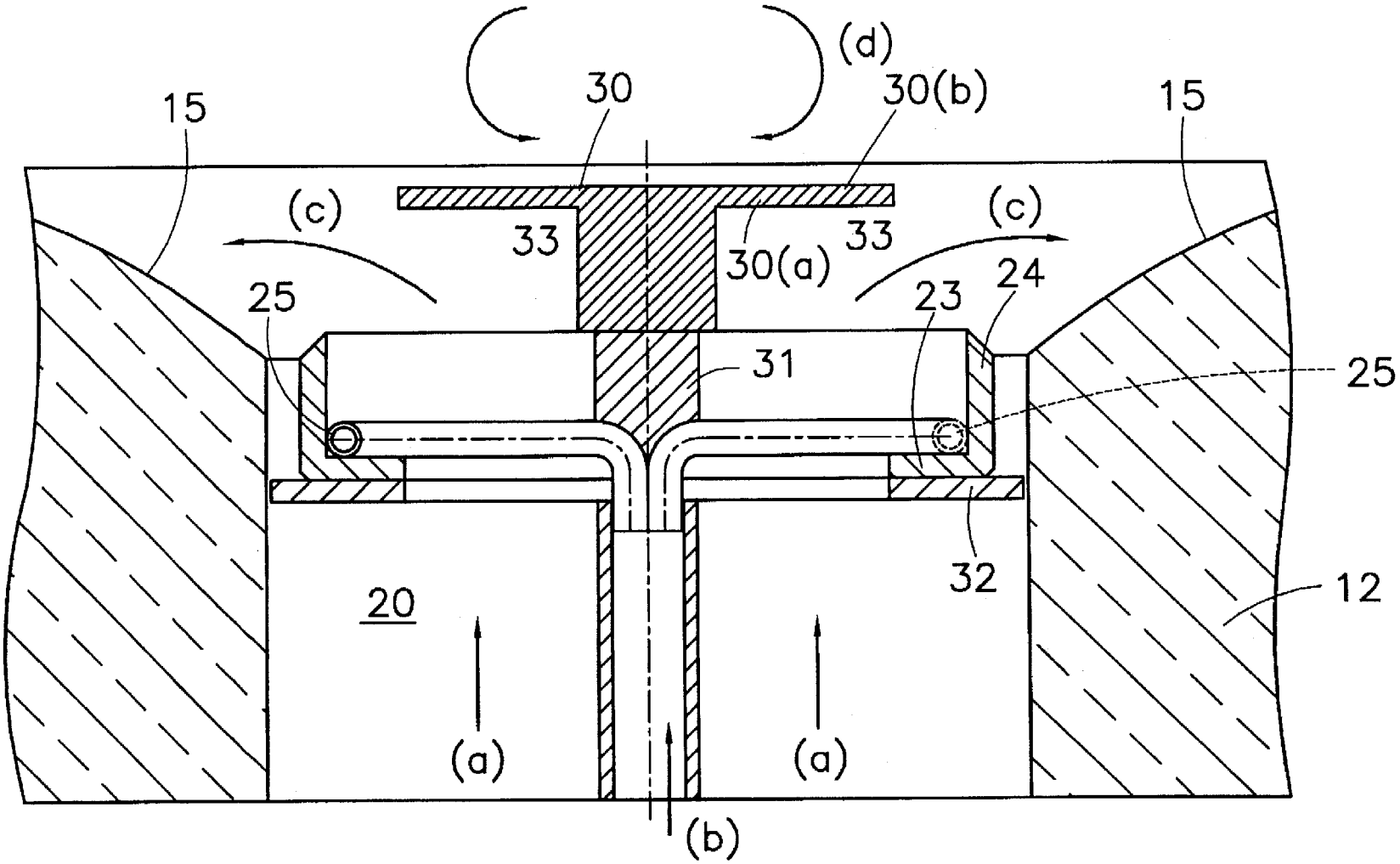
FIG. 2 is an enlarged view of a portion of FIG. 1.

Turning now to FIG. 2 of the drawings, the operation of the burner of FIG. 1 will be explained in further detail. It will be appreciated that the flame ring 24 cooperates with the open base ring 23 to form a burner cup in which incoming gas (b) is caused to swirl as a result of angular momentum from the peripherally arranged vortex tubes 25, 25. Primary air flows along the paths (a), (a) through the middle portion of the modulating ring 32 and into the burner cup within the flame ring 24. This causes a swirling motion of the gas which is ignited as it mixes with the primary air and flows into the area above the burner cup and beneath the diverter plate 30. This creates a premix area 33. Diverter plate 30 redirects the axial movement initiated by the primary air (a) and, in combination with the swirling movement of the fuel gas, forces a continuous outward movement of the burning premix along an outwardly directed path schematically depicted as (c) in FIG. 2. This causes the burning mixture to cling closely along the convex refractory surface 15 of the burner block 12. Accordingly, the deflecting plate 30 is located in a position to deflect the mixture of fuel gas and primary air outwardly away from the longitudinal downstream direction, for flow sidewardly along the surface of the cup.

As will be observed in FIG. 2, the deflecting plate 30 extends substantially completely across the flow path of the primary air and the fuel gas in the bore 20 and is spaced downstream of the bore 20. It has an upstream surface **30*a* facing the nozzles 25, 25 and a downstream surface 30*b* facing the inner portion of the furnace. The surface 30*b* is further significant in that it serves to deflect any ambient combustion products that are generated within the body of the furnace, which combustion products tend to return to the burner along the pathways (d), (d) as shown in FIG. 2. The upstream surface 30(*b*) prevents interference with the efficient operation of the burner and avoids migration of hot furnace gases outwardly through the bore 20**, which could otherwise cause overheating of exterior furnace parts and structures.

In this connection, it will be further appreciated that the presence of the modulating ring 32 is important not only because it prevents the incoming air primary (a) from passing around the outer periphery of the flame ring 24, thus helping the liquified petroleum gas flame to cling to the burner cup wall. It also prevents recirculating furnace gas combustion products from passing countercurrently through the same space between the flame ring 24 and the bore 20.

Figure 3:
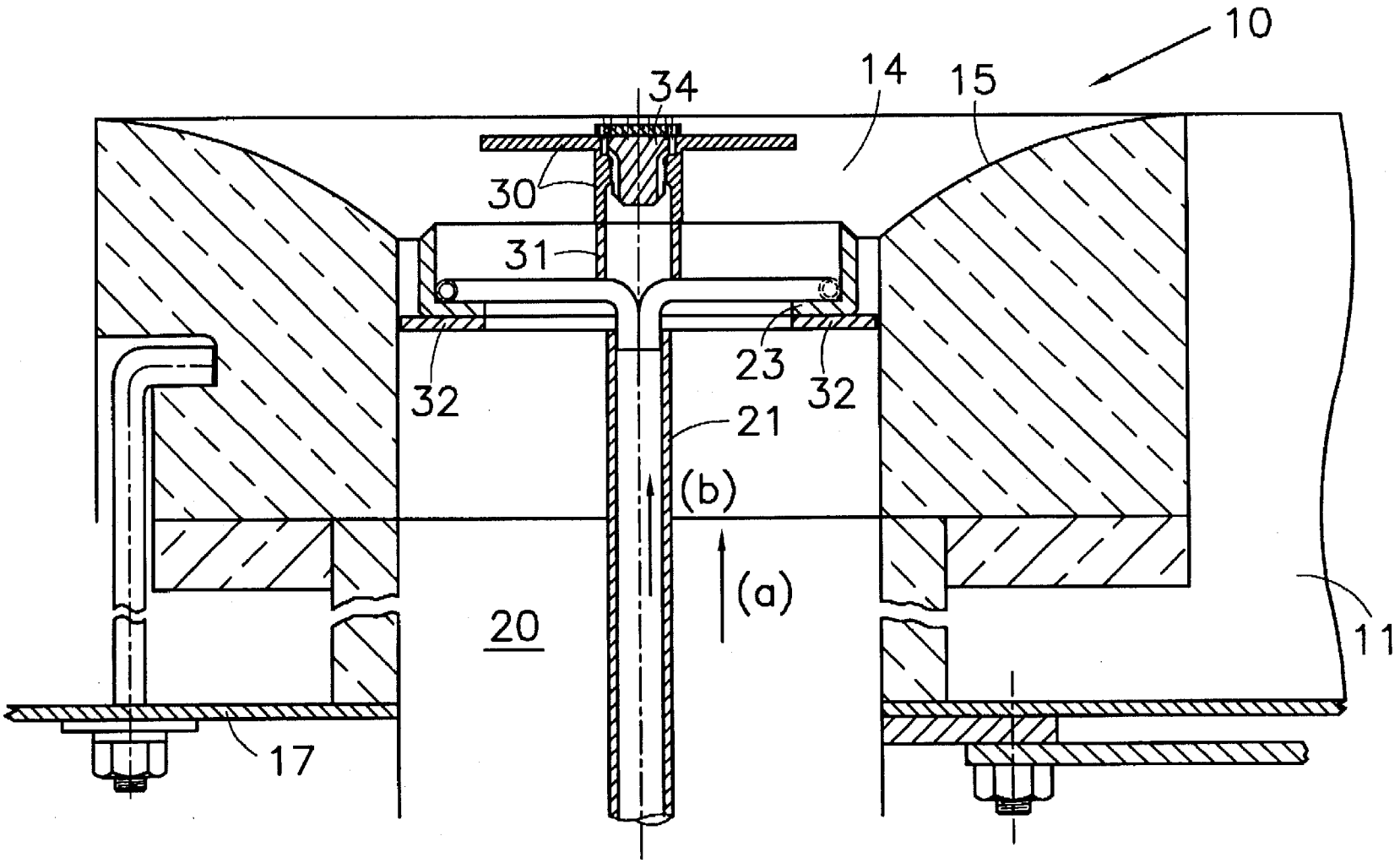
FIG. 3 is a view in side elevation of an alternative form of vortex burner according to this invention, with certain portions shown in section.
Figure 4:
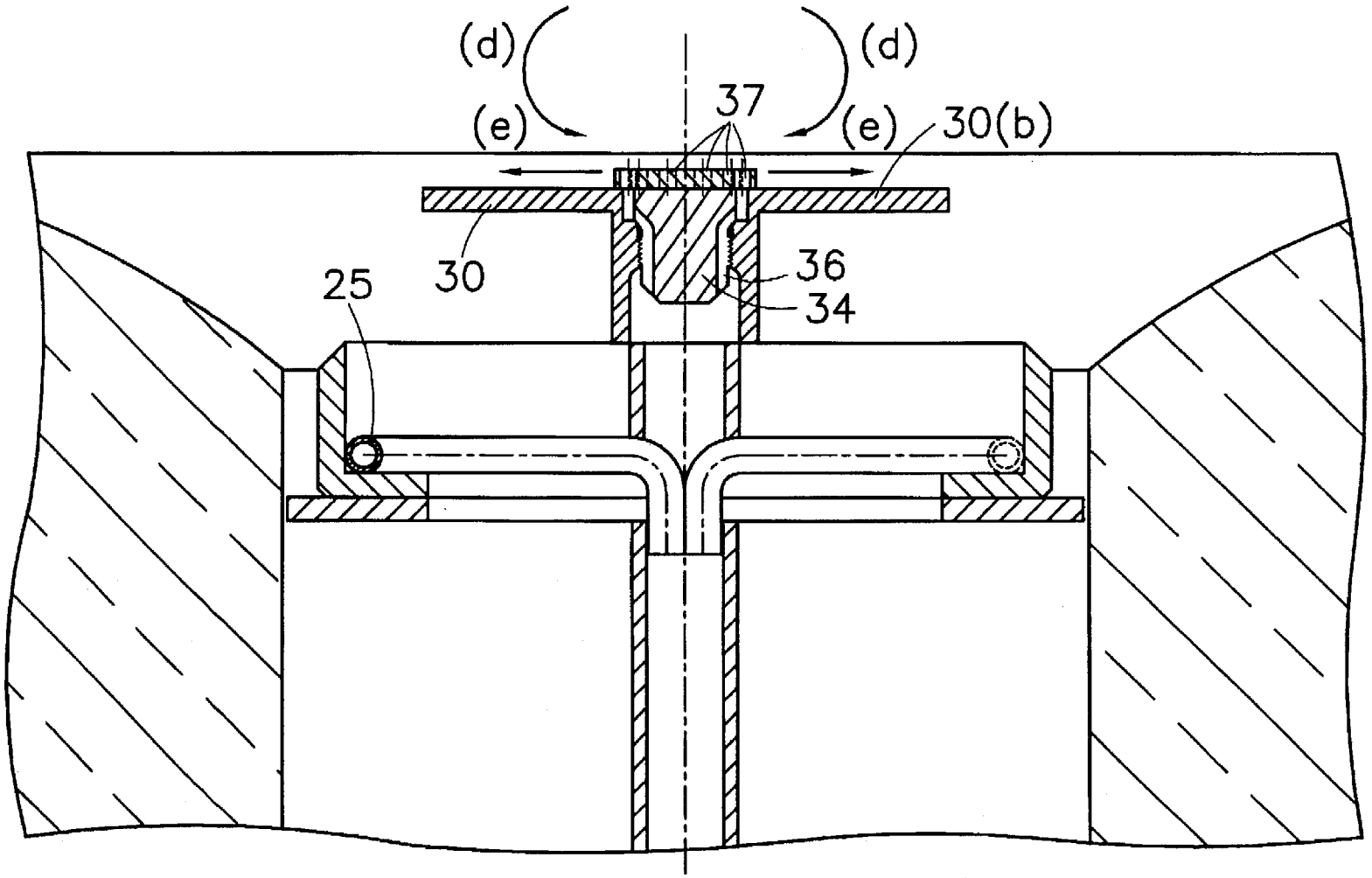
FIG. 4 is an enlarged view of a portion of FIG. 3.
Figure 5:
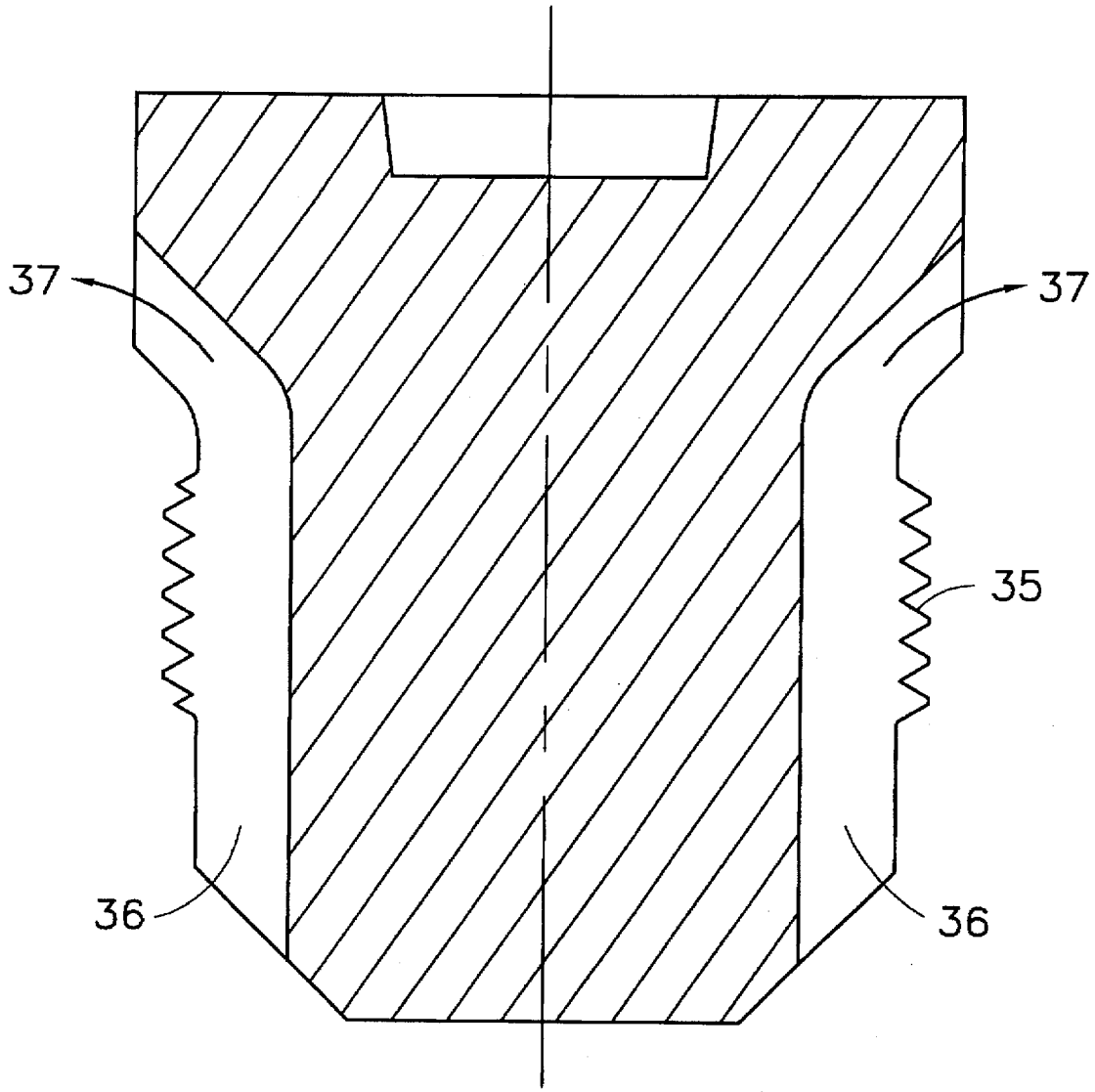
FIG. 5 is an enlarged cross-sectional view of a secondary fuel feed cone of the type appearing in FIGS. 3 and 4.

FIG. 3 shows an alternative form of the invention particularly effective for achieving especially low nitrogen oxide values in the combustion products. The passageway of fuel gas inlet tube 21 extends through the burner cup 23, the support rod 31 and the supporting portion of the diverter plate 30, providing for the admission of fuel gas to and through the end of diverter plate 30. A gas distribution cone 34, conveniently composed of a high temperature ceramic material, is screwed into the end of the diverter plate 30 and extends into the fuel gas inlet passageway of the fuel gas inlet tube 21. As is shown in further detail in FIGS. 4 and 5 of the drawings, the gas distribution cone 34 has threads 35 meshing with internal threads in the diverter plate 30, and includes a plurality of spaced apart longitudinal passageways 36, 36 distributed around the periphery of the cone for conducting fuel gas outwardly through outlets 37, 37 as shown in FIG. 5. In this manner, fuel gas is introduced against the downstream surface of the diverter plate 30, which surface is facing the interior of the furnace. This introduces secondary gas into the furnace in a plurality of separate streams, all of them separate from the initial stream of fuel gas which is introduced into and through the vortex nozzles 25.

The secondary gas is injected through a multiplicity of nozzles 37 for flow radially outwardly along the downstream wall 30(*b*) of the diverter plate 30 and reacts with the recirculating furnace gases (d) . Since these recirculating furnace gases are depleted with respect to oxygen, a low temperature reaction occurs with the small remaining oxygen content of the furnace gases. This produces a lower flame temperature, which is believed important. Although the reasons underlying the reduction of $NO_x$ content are not fully developed, the fact is that introduction of secondary gas minimizes the production of oxides of nitrogen. This is highly advantageous in view of the prevailing environmental interest in minimization of $NO_x$ in combustion gases.

The invention is further illustrated with reference to the following examples:

EXAMPLES

A burner according to FIG. 1 was mounted in a standard Selas K9206 burner block and connected to feed pipes providing natural gas, hydrogen and propane. The fuel gas was introduced through No. 42 orifices and burning was conducted in a standard ceramic block test furnace.

The following results were determined separately for natural gas, hydrogen and propane. There was no significant overheating of the burner in any case, the noise levels were good, and no nozzle changes were needed or made. The flames were observed to cling to the burner cup and to the surrounding inner wall of the furnace in each case.

The results of the tests are as follows:

Raw Data

| Btu/hour fuel burned | Air Control Shutter Opening (inches) | Fuel | Fuel Gas Pressure (psig) | Flue Gas Oxygen % | Flue Gas $NO_x$ ppm | Flue Draft (inches $H_2O$) | Flue Gas CO ppm | Furnace Temp °F. Temp Front | Furnace Temp °F. Temp Back | Incoming Gas Flow Rate Standard cu ft/min | Decibel Averages (Noise) |
|---|---|---|---|---|---|---|---|---|---|---|---|
| 630,000 | 3 ¾ | 100% natural gas | 24.2 | 2% | 41 | .21 | 3.4 | 1651 | 1725 | 910 | 67.7 |
| | | | | | | | | Background noise | | | 60.1 |
| 630,000 | 6 ¾ | 100% propane | 12 | 2.2 | 52 | .21 | 3.5 | 1672 | 1732 | 175 | 69.8 |
| 600,000 | 3.5 | 100% hydrogen | 29 | 2.6 | 34 | .21 | 3.9 | 1667 | 1202 | 330 | 72.8 |

Although this invention is highly efficient for burning either hydrogen or liquified petroleum gas alone, it is easily possible with this burner to burn a mixture of such fuels; the burning of either or both together is effective.

Although this invention has been described with reference to specific forms thereof, certain modifications having been mentioned in the specification, it will be appreciated that a wide variety of other changes including the use of various mixtures of propane and butane, or the use of concave burner cups or cups of special design, may be made without departing from the spirit and scope of the invention.

The feed of fuel gas and air may alternatively be provided through an inner feed tube within a feed tube, with the resulting annular space connected to one burner tip and the inner tube connected to the other burner tip. The invention is not limited to the use of only two burner tips but may provide three, four or more.

Additionally, the tube within a tube arrangement may provide an air supply to one or the other of the passageways, and this air supply may be connected for distribution through the ceramic tip openings 37 of FIG. 5 for even further reduction of content of oxides of nitrogen in the combustion gas.

Although this invention has been described with reference to specific forms of burners, cups and furnaces, certain modifications having been shown in the drawings or mentioned in the specification, it will be appreciated that a wide variety of other changes may be made without departing from the spirit and scope of the invention. For example, equivalent elements may be substituted for those specifically shown and described, parts may be reversed, and certain features may be used independently of other features, all without departing from the spirit and scope of the invention as defined in the appended claims.

What is claimed is:

1. A vortex burner assembly comprising:

a. a burner block adapted to be positioned in a furnace wall, said block including a burner cup and having a bore extending through said block and into the cup base;

b. primary air supply means connected to said bore and extending through said burner cup;

c. fuel gas supply means extending along said burner block and connected for supplying fuel gas along with said primary air;

d. means including vortex nozzles arranged for imparting a swirling flow pattern to the fuel gas;

e. means for joining said swirling gas with said primary air to form a swirling gas-air mixture downstream of said vortex nozzles; and f. a deflecting plate spaced downstream from said vortex nozzles and from said burner cup, said deflecting plate being arranged crosswise in a position to deflect said mixture of fuel gas and primary air outwardly away from said downstream direction for flow sidewardly along the surface of said burner cup.

2. The vortex burner defined in claim 1, wherein said deflecting plate extends in a cross-wise direction across the flow path of said primary air and fuel gas in said bore, and is spaced downstream of said bore.

3. The vortex burner defined in claim 1, wherein said deflecting plate has an upstream surface facing said nozzles and a downstream surface facing said furnace, and wherein secondary fuel gas means are provided extending through said deflecting plate to said downstream face of said deflecting plate to supply secondary fuel gas to said downstream face.

4. The vortex burner defined in claim 3, wherein a further distribution means is provided at said downstream face of said deflecting plate for spreading said secondary fuel gas along said downstream face for reaction with recirculating gases from within said furnace.

5. The vortex burner defined in claim 4, wherein said further distribution means is a ribbed ceramic plug adapted to be screwed into the end of said further fuel gas supply means, said plug having a plurality of passages forming a plurality of spaced-apart flow passages for distributing said secondary fuel gas.

6. The vortex burner defined in claim 1, wherein the burner cup has an exvoluted surface.

7. The vortex burner defined in claim 1, wherein a modulating ring is provided extending outwardly from said vortex nozzles and substantially completely covering an adjacent portion of said burner block opening to block retroflow of combustion products countercurrently through said burner block opening.

8. The vortex burner defined in claim 1, wherein said deflector plate is positioned adjacent a plane of said internal furnace wall.

9. A vortex burner for burning either hydrogen or propane or a mixture thereof, including a burner block having an internal wall and having a cup-shaped recess at one surface of said block and an opening extending from the base of said cup-shaped recess and extending to the opposite surface of said block;

said burner including:

a. means forming a passageway for primary air;

b. means forming an annular shaped flame ring disposed in said passageway;

c. a fuel feed pipe extending along said primary air passageway;

d. a set of gas distribution tubes extending from said feed pipe and positioned substantially peripherally within said flame ring to form a swirling mixture of fuel gas and primary air flowing in a downstream direction in said primary air passageway; and e. a deflector plate spaced downstream of said flame ring and downstream of said gas distribution tubes and extending in a cross-wise direction across said flow of fuel and primary air to divert said downstream flow and to force said mixture to flow outwardly along said burner cup.

10. The vortex burner defined in claim 9, wherein the burner cup has an exvoluted surface.

11. The vortex burner defined in claim 9, wherein a modulating ring is provided extending outwardly from said flame ring and substantially completely covering an adjacent portion of said burner block opening, to impede inward flow of primary air or retroflow of combustion products adjacent said burner block.

12. The vortex burner defined in claim 9, wherein said deflector plate is positioned adjacent a plane of the internal furnace wall.

* * * * *